US012613052B2

(12) United States Patent
Fultz

(10) Patent No.: US 12,613,052 B2
(45) Date of Patent: Apr. 28, 2026

(54) SYSTEMS AND METHODS FOR BLOWER CONTROL IN AN HVAC SYSTEM

(71) Applicant: Copeland Comfort Control LP, St. Louis, MO (US)

(72) Inventor: James D. Fultz, Ceres, CA (US)

(73) Assignee: Copeland Comfort Control LP, St. Louis, MO (US)

( * ) Notice: Subject to any disclaimer, the term of this patent is extended or adjusted under 35 U.S.C. 154(b) by 406 days.

(21) Appl. No.: 18/308,833

(22) Filed: Apr. 28, 2023

(65) Prior Publication Data

US 2024/0361032 A1 Oct. 31, 2024

(51) Int. Cl.
*F24F 11/65* (2018.01)
*F24F 110/12* (2018.01)
*F24F 110/20* (2018.01)

(52) U.S. Cl.
CPC ..... *F24F 11/65* (2018.01); *F24F 2110/12* (2018.01); *F24F 2110/20* (2018.01)

(58) Field of Classification Search
CPC .... F24F 11/65; F24F 2110/12; F24F 2110/20; F24F 11/30; F24F 11/64; F24F 11/77; F24F 2110/10; F24F 2110/22; F24F 11/0008; F24F 11/46; Y02B 30/70
See application file for complete search history.

(56) References Cited

U.S. PATENT DOCUMENTS 5,062,276 A 11/1991 Dudley
6,282,910 B1 9/2001 Helt
6,513,723 B1 2/2003 Mueller et al.
7,640,761 B2 1/2010 Garett et al.
11,009,249 B2 5/2021 Goel et al.
2007/0032187 A1 2/2007 Liu
2007/0261422 A1* 11/2007 Crawford ..... F24F 11/0008 62/176.1
2009/0134232 A1 5/2009 Larsen
2010/0070092 A1 3/2010 Winter et al.
2010/0269521 A1 10/2010 Moore
2016/0313040 A1* 10/2016 Trudeau ..... F25B 49/022
2017/0146257 A1* 5/2017 Goel ..... F24F 11/81
2020/0166234 A1* 5/2020 Leman ..... F24F 11/77
2021/0148590 A1* 5/2021 Aschenberg ..... F24F 11/0008
2021/0237535 A1 8/2021 Goel et al.
(Continued)

FOREIGN PATENT DOCUMENTS

WO WO-2022160763 A1 * 8/2022 ..... F24F 11/0008

*Primary Examiner* — Alicia M. Choi
(74) *Attorney, Agent, or Firm* — Armstrong Teasdale LLP

(57) ABSTRACT

A method of conditioning air within an enclosed space using an HVAC system includes controlling, by a controller, the HVAC system to cool the air within an enclosed space in response to a command from a thermostat that monitors a temperature in the enclosed space. The controller receives a humidity reading from the humidity sensor and determines whether to operate at improved cooling efficiency or at improved dehumidification efficiency based at least in part on the humidity reading. The controller determines an operating speed for the blower to achieve the determined operation at improved cooling efficiency or operation at improved dehumidification efficiency and continues to control the HVAC system to condition the air within the enclosed space including operating the blower at the determined operating speed.

18 Claims, 5 Drawing Sheets

(56) References Cited

U.S. PATENT DOCUMENTS

| | | | | |
|---|---|---|---|---|
| 2023/0063806 | A1* | 3/2023 | Walser | F24F 11/49 |
| 2023/0086486 | A1* | 3/2023 | Goel | F24F 11/46<br>62/228.4 |
| 2024/0167710 | A1* | 5/2024 | Lee | F24F 11/63 |

* cited by examiner

SYSTEMS AND METHODS FOR BLOWER CONTROL IN AN HVAC SYSTEM

BACKGROUND

This application relates generally to heating ventilation and air conditioning (HVAC) systems. More specifically, the application relates to systems and methods for controlling the blower in an HVAC system.

To create maximum indoor comfort, humidity must first be removed from a conditioned space before temperature can drop. Dehumidification occurs at different rates depending on airflow rates going across the evaporator coil in an HVAC system.

As air flows across the evaporator coil, the coil absorbs heat from the air. As the air gives up its heat, it also gives up its moisture. The slower the air moves across a coil, the more time it has to remove moisture. The faster the air moves across a coil the less time the air has to give up its moisture.

Increasing the airflow across an evaporator coil (e.g., by up to 50 cfm) allows for more air to pass and increases heat transfer. This results in shorter run time to accomplish sensible heat removal. Shorter run time increases system efficiency by using less compressor energy to reach the desired comfort level. However, this increased efficiency is achieved at the cost of less moisture being removed from the air because of the increased air flow.

Different parts of the United States have different cooling dehumidification needs. Typical HVAC controllers are configured at installation based at least in part on the average humidity in the part of the United States in which the system is being installed. HVAC controllers in areas with high humidity are configured to operate their HVAC system blower at slower speeds than areas with lower humidity. For example, in a high humidity region, the HVAC controller may be configured to operate the blower to achieve 350 cubic feet per minute (CFM) per ton, while in a low humidity region the HVAC controller may operate the blower to achieve 450 CFM per ton. In a region that has a middle level of humidity (e.g., between the high and low humidity), the HVAC controller may operate the blower to achieve 400 CFM per ton.

The controllers in at least some known systems use the same blower CFM/ton settings that are initially set without regard for the current conditions being experienced. Thus, if a homeowner opens the windows of her home and lets in high humidity air, the controller operates with same blower settings as it would if the house were filled with drier (lower humidity) air. Similarly, if the area around the HVAC system is experiencing humidity that differs from the average humidity for the area (and for which the system was configured), the controller does not change its control of the blower to compensate for the different conditions. For example, in a low humidity region, when the air is more humid than normal/average, the controller does not change its low humidity/high CFM operation, and the humidity is not reduced as quickly as possible. Conversely, in a high humidity region, if the air is drier than normal, the controller in the HVAC system continues as initially configured and does not increase the blower CFM to improve efficiency even though less moisture needs to be removed from the air.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

One aspect of this disclosure is a method of conditioning air within an enclosed space using a heating ventilation and air condition (HVAC) system including a humidity sensor, a blower in fluid communication with the enclosed space, and a controller having a processor and a memory. The method includes controlling, by the controller, the HVAC system to cool the air within the enclosed space in response to a command from a thermostat that monitors a temperature in the enclosed space, the controlling including operating the blower at a first speed to produce a first rate of airflow. The controller receives a humidity reading from the humidity sensor and determines whether to continue operating the blower at the first speed or to operate the blower at a second speed to produce a second rate of airflow based at least in part on the humidity reading. The controller continues to control the HVAC system to condition the air within the enclosed space while operating the blower at the first speed or the second speed based on the determination of whether to continue operating the blower at the first speed or to operate the blower at a second speed.

Another aspect of the disclosure is a method of conditioning air within an enclosed space using a heating ventilation and air condition (HVAC) system including a humidity a blower sensor, in fluid communication with the enclosed space, and a controller having a processor and a memory. The method includes controlling, by the controller, the HVAC system to cool the air within the enclosed space in response to a command from a thermostat that monitors a temperature in the enclosed space, receiving, by the controller, a humidity reading from the humidity sensor, and determining, by the controller, whether to operate at improved cooling efficiency or at improved dehumidification efficiency based at least in part on the humidity reading. The controller determines an operating speed for the blower to achieve the determined operation at improved cooling efficiency or operation at improved dehumidification efficiency, and continues to control the HVAC system to condition the air within the enclosed space including operating the blower at the determined operating speed.

According to another aspect of this disclosure, a controller for a heating ventilation and air condition (HVAC) system with a blower in fluid communication with an enclosed space includes a processor and a memory. The memory stores instructions that when executed by the processor cause the processor to: control the HVAC system to cool the air within the enclosed space in response to a command from a thermostat that monitors a temperature in the enclosed space, the control including operating the blower at a first speed to produce a first rate of airflow; receive a humidity reading from a humidity sensor; determine whether to continue operating the blower at the first speed or to operate the blower at a second speed to produce a second rate of airflow based at least in part on the humidity reading; and continue controlling the HVAC system to condition the air within the enclosed space while operating the blower at the first speed or the second speed based on the determination of whether to continue operating the blower at the first speed or to operate the blower at a second speed.

Various refinements exist of the features noted in relation to the above-mentioned aspects. Further features may also be incorporated in the above-mentioned aspects as well.

These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

Example embodiments are described herein with reference to an example heat exchange system for convenience. The teachings of this disclosure may be applied to any HVAC system or any other system including a five tap motor whose speed is to be controlled by a system controller.

Figure 1:
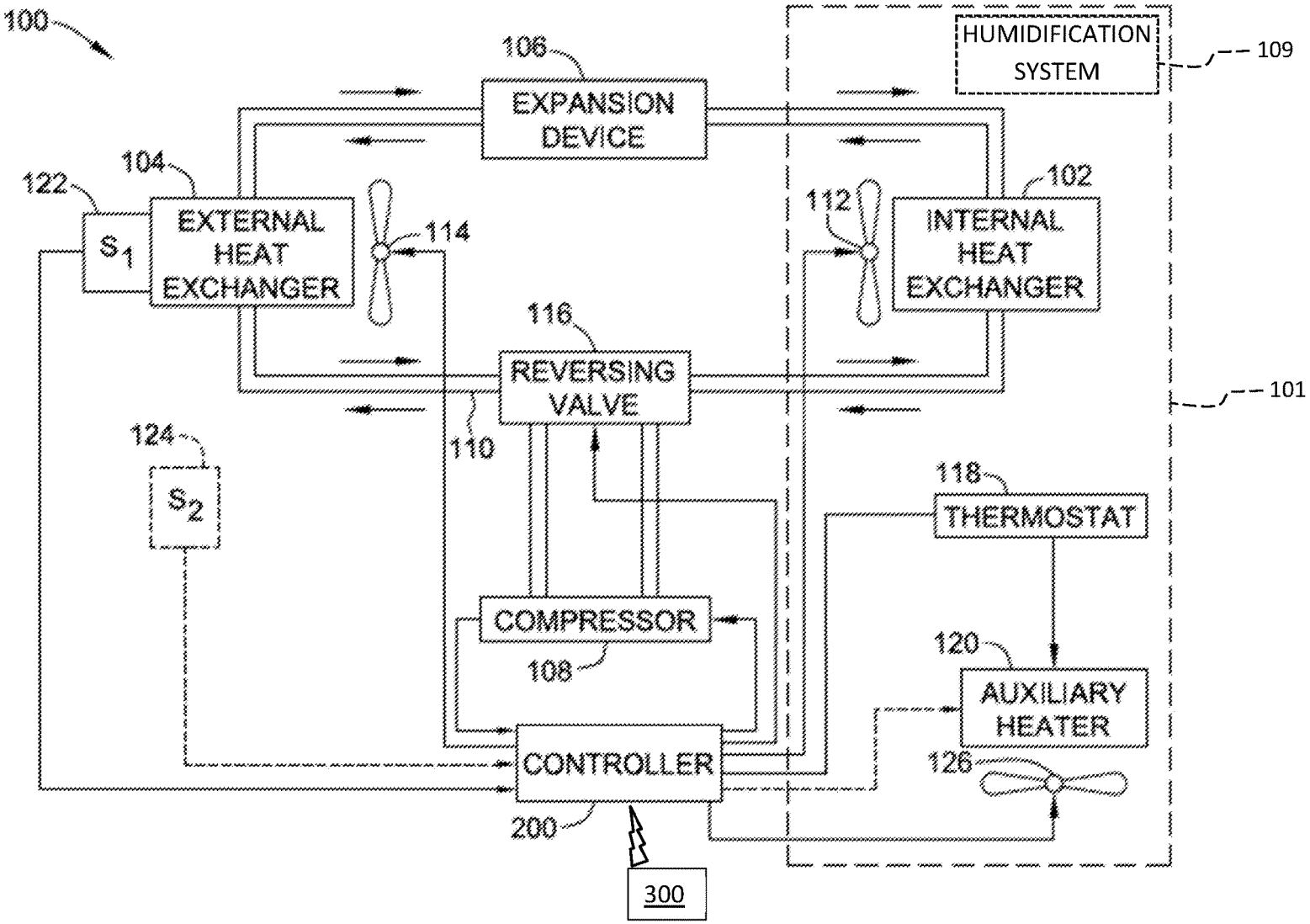
FIG. 1 is a schematic diagram of a heat exchange system including a controller.

Referring to FIG. 1, an example heat exchange system of one embodiment for heating and cooling a temperature controlled environment is indicated generally at 100. The heat exchange system is operable to condition air within an enclosed space 101. The heat exchange system 100 generally includes an internal heat exchanger 102, an external heat exchanger 104, an expansion device 106 fluidly connected between the heat exchangers 102, 104, and a compressor 108. The system 100 may optionally include a humidification system 109 for adding humidity to the enclosed space 101. The external heat exchanger 104, the expansion valve 106, the internal heat exchanger 102, and the compressor 108 are connected in fluid communication by conduits 110.

Refrigerant is circulated through the system 100 by the compressor 108. An internal blower 112 forces air from the temperature controlled environment into contact with the internal heat exchanger 102 to exchange heat between the refrigerant and the temperature controlled environment. The internal blower 112 subsequently forces the air back into the temperature controlled environment. Similarly, an external blower 114 forces air from an ambient environment into contact with the external heat exchanger 104, and subsequently back into the ambient environment. The direction of refrigerant flow is controlled by a reversing valve 116 fluidly connected between the compressor 108 and each heat exchanger 102, 104.

The operation of the system 100 is generally controlled by a controller 200 (sometimes referred to as an HVAC controller) and a thermostat 118 coupled to the controller 200. The controller may be an IFC, A/H, or any other suitable HVAC controller. The thermostat 118 is coupled to one or more temperature sensors (not shown) for measuring the temperature of the temperature controlled environment. The controller 200 is coupled to the reversing valve 116, the compressor 108, and the blowers 112, 114 for controlling operation of the components in response to control signals received from the thermostat 118 and for controlling operation of the components during defrost cycles. In some embodiments, the controller 200 is also coupled to the humidification system 109 for controlling operation of the humidification system.

The system 100 also includes an auxiliary heater 120 and auxiliary blower 126 coupled to the controller 200 and the thermostat 118. The auxiliary heater 120 is configured to supply additional heat to the system 100 when the system is in a heating mode and/or to supply heat to the temperature controlled environment when the system 100 is in a defrost mode. In alternative embodiments, the auxiliary heater 120 is omitted from the system 100.

The system 100 also includes sensors 122, 124 for monitoring environmental conditions of the system 100. Sensors 122, 124 are coupled to the controller 200 for relaying information about the system 100 to the controller 200 in the form of electrical signals. In the illustrated embodiment, sensors 122, 124 are temperature sensors. The system 100 may include additional or alternative sensors, such as photo-optical sensors, humidity sensors, pressure sensors, tactile sensors, and refrigerant pressure sensors.

In operation, the compressor 108 receives gaseous refrigerant that has absorbed heat from the environment of one of the two heat exchangers 102, 104. The gaseous refrigerant is compressed by the compressor 108 and discharged at high pressure and relatively high temperature to the other heat exchanger. Heat is transferred from the high pressure refrigerant to the environment of the other heat exchanger and the refrigerant condenses in the heat exchanger. The condensed refrigerant passes through the expansion device 106, and into the first heat exchanger where the refrigerant gains heat, is evaporated and returns to the compressor intake.

The controller 200 is wirelessly connectable with a mobile device 300, such as a smart phone, tablet, laptop, etc., (hereinafter referred to as "mobile device.") In other embodiments, the controller 200 is connectable to the mobile device 300 additionally or alternatively using a wired connection. The mobile device 300 has a processor and memory that includes and/or has access to a software application executable to configure the controller 200 as further described below. The mobile device 300 also has a display, such as a touchscreen and, in various embodiments, a voice processing capability.

Figure 2:
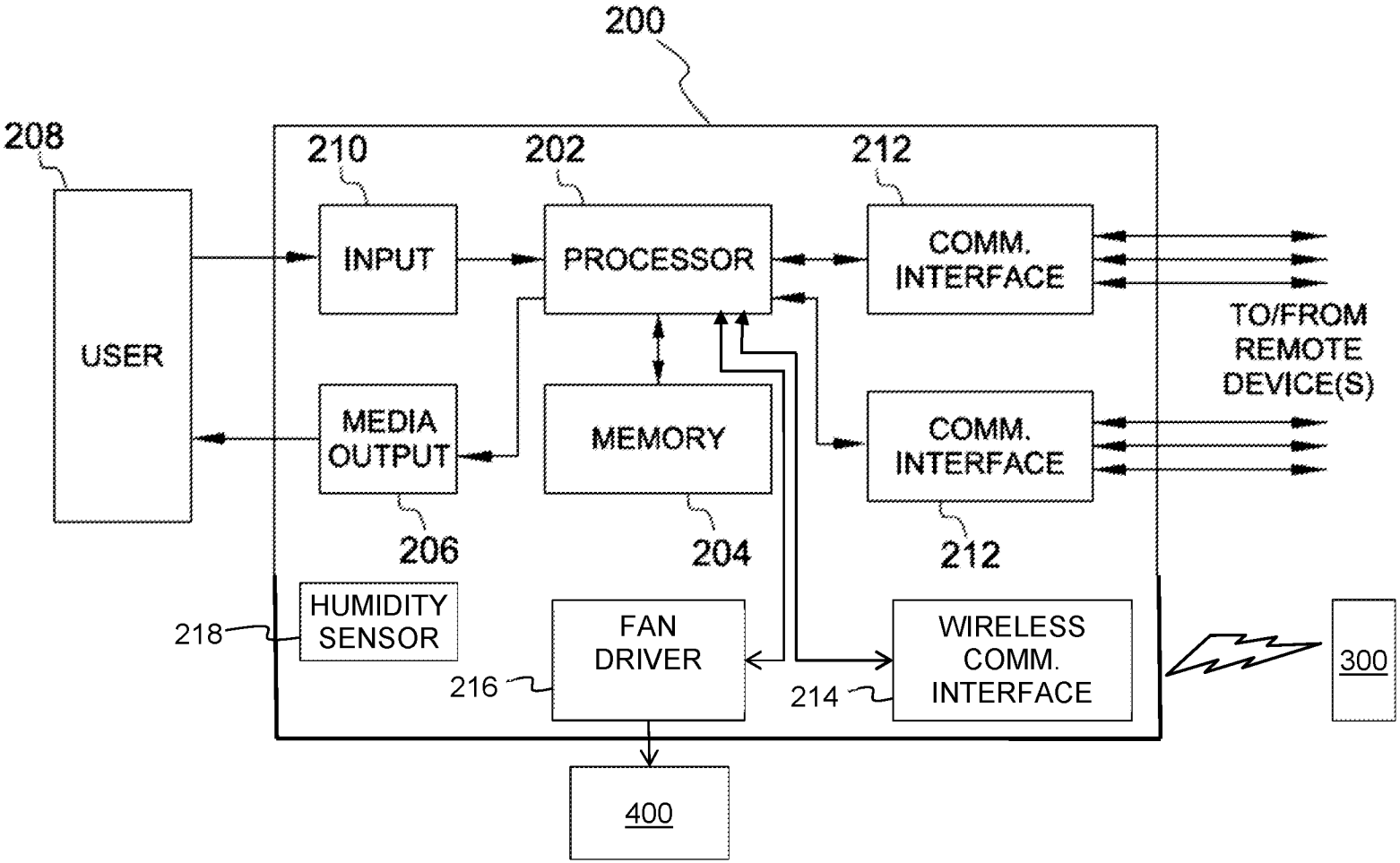
FIG. 2 is a block diagram of the controller of FIG. 1.

FIG. 2 is an example configuration of the controller 200 for use in the system 100. The controller 200 includes a processor 202, a memory 204, a media output component 206, an input device 210, wired communications interfaces 212, wireless communications interface 214, a fan driver 216, and a humidity sensor 218. Other embodiments include different components, additional components, and/or do not include all components shown in FIG. 2.

The processor 202 is configured for executing instructions. In some embodiments, executable instructions are stored in the memory 204. The processor 202 may include one or more processing units (e.g., in a multi-core configuration). The memory 204 is any device allowing information such as executable instructions and/or other data to be stored and retrieved. The memory 204 may include one or more computer-readable media.

The media output component 206 is configured for presenting information to a user 208. The media output component 206 is any component capable of conveying information to the user 208. In the example embodiment, the media output 206 is one or more LEDs. In some embodiments, the media output component 206 includes an output adapter such as a video adapter and/or an audio adapter. The output adapter is operatively connected to the processor 202 and operatively connectable to an output device such as a display device (e.g., a liquid crystal display (LCD), organic light emitting diode (OLED) display, cathode ray tube (CRT), "electronic ink" display, one or more light emitting diodes (LEDs)) or an audio output device (e.g., a speaker or headphones).

The controller 200 includes, or is connected to, the input device 210 for receiving input from the user 208. The input device is any device that permits the controller 200 to receive analog and/or digital commands, instructions, or other inputs from the user 208, including visual, audio, touch, button presses, stylus taps, etc. The input device 210 may include, for example, DIP switches, a variable resistor, an input dial, a keyboard/keypad, momentary push button/buttons, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 206 and the input device 210.

The memory 204 stores computer-readable instructions for control of the system 100 as described herein. In some embodiments, the memory area stores computer-readable instructions for providing a user interface to the user 208 via media output component 206 and, receiving and processing input from input device 210. The memory 204 includes, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory usable for storage of a computer program.

The communication interfaces 212 and 214 enable the controller 200 to communicate with remote devices and systems, such as sensors (including remote humidity sensors), valve control systems, safety systems, remote computing devices, other components of the system, and the like. The communication interfaces 212 may be wired or wireless communications interfaces that permit the computing device to communicate with the remote devices and systems directly or via a network. Wireless communication interfaces may include a radio frequency (RF) transceiver, a Bluetooth® adapter, a Wi-Fi transceiver, a ZigBee® transceiver, an infrared (IR) transceiver, and/or any other device and communication protocol for wireless communication. (Bluetooth is a registered trademark of Bluetooth Special Interest Group of Kirkland, Washington; ZigBee is a registered trademark of the ZigBee Alliance of San Ramon, California.) Wired communication interfaces 212 may use any suitable wired communication protocol for direct communication including, without limitation, USB, RS232, I2C, SPI, analog, and proprietary I/O protocols. In some embodiments, the wired communication interfaces 212 include a wired network adapter allowing the computing device to be coupled to a network, such as the Internet, a local area network (LAN), a wide area network (WAN), a mesh network, and/or any other network to communicate with remote devices and systems via the network.

In the example embodiment, the communication interface 214 (sometimes referred to as the controller communication interface) is a near field communication (NFC) transceiver operable for wireless communication with a nearby NFC communication enabled remote device, such as mobile device 300. Information may be retrieved from controller 200 or transmitted to controller 200 using the wireless communication interface 214 when the controller 200 is powered on and/or when it is powered off. Because NFC communication requires that the communicating transceivers be in close proximity (e.g., about one inch apart or closer), the mobile device 300 and the controller 200 may only communicate via NFC when the mobile device 300 is in close proximity to the controller 200. Thus, the user/installer may input into the mobile device 300 or the mobile device may select settings or other data to be provided to the controller 200 (e.g., the user may configure the system 100) when the mobile device 300 is not in close proximity to the controller 200 (and thus not communicating with the controller 200), and then place the mobile device 300 in close proximity to the controller 200 to establish communication and transmit the information from the mobile device 300 to the controller 200. References to communicating via NFC or being in communication with a device via NFC herein refers to being in communication when in close proximity to each other.

In other embodiments, the controller communication interface 214 may include a radio frequency (RF) transceiver, a Bluetooth® adapter, a Wi-Fi transceiver, a ZigBee® transceiver, an infrared (IR) transceiver, and/or any other device and communication protocol for wireless communication. In still other embodiments, the controller communication interface 214 is a wired communication interface.

In some embodiments, the only communication interface for communication between the controller 200 and a remote/mobile device is the controller communication interface 214. In such other embodiments, communication interfaces 212 may be present, but only for control of or communication with or control of one or more other component of the system 100.

Fan driver 216 is communicatively coupled to a motor 400 of a fan (also referred to as a blower) in the system 100. The motor 400 is a five tap motor. The motor 400 may be the motor of any of external blower 114, internal blower 112, or auxiliary blower 126. Further, the motor 400 may be any five tap motor within the system 100. In some embodiments, each blower in the system 100 is connected to a separate fan driver 216 and separately controlled. For simplicity of description, a single fan driver 216 and a single motor 400 will be described herein. The fan driver 216 instructs the motor 400 at what speed to run during various modes, such as heating, cooling, fan only, and the like. The modes are sometimes also referred to herein as operating conditions. In some embodiments, the fan driver 216 commands a particular speed by applying a 24 volt AC signal to one or more of the taps of the motor 400.

The humidity sensor 218 measures the humidity around the controller 200. Although shown near the other components of the controller 200, the humidity sensor may be remotely located from the rest of the components of the controller 200, for example to monitor the humidity at a location remote form the controller (a particular room in the conditioned space, an outdoor humidity, or the like). Moreover, more than one humidity sensor 218 may be used with the controller 200 in order to monitor the humidity in more than one location at the same time. Further, remotely located humidity sensors 218 may communicate with the controller through the communications interfaces 212 or 214. Although shown and described as part of the controller 200, the humidity sensor(s) 218 (and especially remote humidity sensors) may be considered separate sensors that communicate with the controller.

Figure 3:
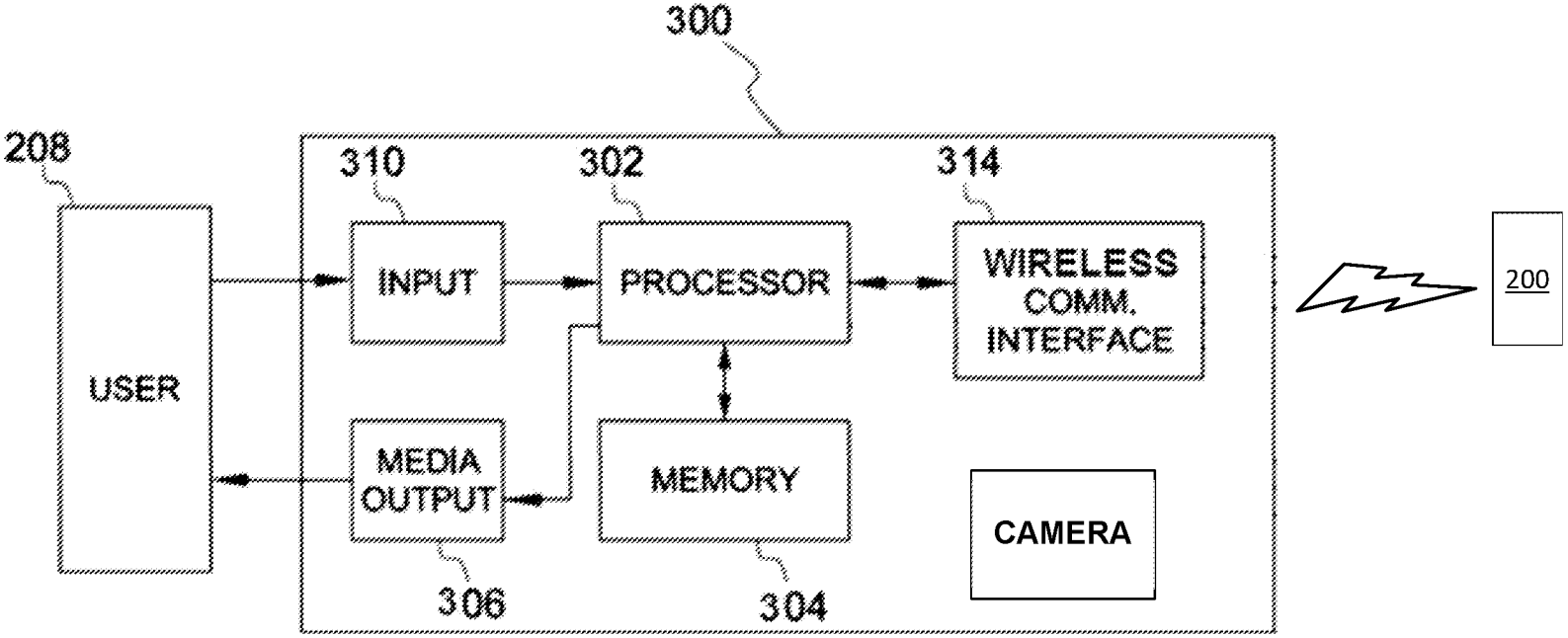
FIG. 3 is a block diagram of a mobile device for use with the system shown in FIG. 1.

FIG. 3 is an example configuration of the mobile device 300 for use with the system 100. The mobile device 300 includes a processor 302, a memory 304, a media output component 306, an input device 310, wired communications interfaces 312, and wireless communications interface 314. Other embodiments include different components, additional components, and/or do not include all components shown in FIG. 3.

The processor 302 is configured for executing instructions. In some embodiments, executable instructions are stored in the memory 304. The processor 302 may include one or more processing units (e.g., in a multi-core configuration). The memory 304 is any device allowing information such as executable instructions and/or other data to be stored and retrieved. The memory 304 may include one or more computer-readable media.

The media output component 306 is configured for presenting information to a user 308. The media output component 306 is any component capable of conveying information to the user 308. In some embodiments, the media output component 306 includes an output adapter such as a video adapter and/or an audio adapter. The output adapter is operatively connected to the processor 302 and operatively connectable to an output device such as a display device (e.g., a liquid crystal display (LCD), organic light emitting diode (OLED) display, cathode ray tube (CRT), "electronic ink" display, one or more light emitting diodes (LEDs)), and/or an audio output device (e.g., a speaker or headphones).

The mobile device 300 includes the input device 310 for receiving input from the user 308. The input device is any device that permits the mobile device 300 to receive analog and/or digital commands, instructions, or other inputs from the user 308, including visual, audio, touch, button presses, stylus taps, etc. The input device 310 may include, for example, keyboard/keypad, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 306 and the input device 310.

The memory 304 stores computer-readable instructions for operation of the mobile device 300. The memory 304 also stores computer-readable instructions for configuring and communicating with system 100, and specifically for configuring and communicating with the controller 200. In some embodiments, the memory 304 stores computer-readable instructions for providing a user interface to the user 308 via media output component 306 and, receiving and processing input from input device 310. The memory 304 includes, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory.

The wireless communication interface 314 is a near field communication (NFC) transceiver operable for wireless communication with a nearby NFC enabled device, such as controller 200. In other embodiments, the wireless communication interface is any suitable communication interface, such as a Bluetooth communication interface, a Wi-Fi communication interface, or the like. In embodiments in which the wireless communication interface 314 is a NFC transceiver, information may be retrieved from controller 200 or transmitted to controller 200 using the wireless communication interface 214 when the controller 200 is powered on and when it is powered off.

The mobile device 300 may be used to communicate with the controller 200 at different times. During production of the control board or before the control board is installed in the system 100 (or any other system), the user 208 may retrieve or create content such as control instructions, default system settings, controller firmware, or the like, and transmit the content to the controller 200 using the wireless communications interfaces 314 and 214 of the mobile device 300 and controller 200. For NFC communication embodiments, this permits the controller 200 to be programmed or updated by the manufacturer without powering the controller 200, and permits an installer or system manufacturer to program or update the controller 200 before the controller 200 is installed and without need for powering the controller. Thus, for example, an installer may configure the controller for a particular system installation in the shop, in the installation vehicle, or in any other location, without needing to be near the actual HVAC system and without needing to power the controller. Similar actions may be performed in embodiments that do not use NFC communication, but the controller 200 may need to be powered in order for them to be performed. In some embodiments, after the controller is installed in the system 100, the user may use the mobile device 300 to determine the desired configuration of the system 100 and the controller 200 and transmit the configuration (e.g., configuration files, controller settings, and the like) to the controller 200 using the wireless communications interfaces 314 and 214. After the controller 200 is installed and configured, the mobile device may be used to change the configuration or retrieve current configuration data, error data, troubleshooting data, operational history data, and the like from the controller 200 to using the NFC wireless communications interfaces 314 and 214.

By including a wireless communication interface 214 on the controller 200, an installer may use a software application on mobile device 300 to configure the controller 200. A series of menu items may be provided to the installer, who may follow the menu items to install the HVAC control. In various embodiments, a software application menu may list a plurality of HVAC control types that could be configured using the software application, and a user may select from the menu a type of control to configure.

Additionally or alternatively, when a software application on a user's mobile device 300 has been connected with the controller 200, the software application may query the HVAC controller 200 as to its type and thereafter automatically present the appropriate control configuration menu or preset (e.g., default) configuration settings to the user on the mobile device 300. In embodiments in which a controller 200 is to be configured as a replacement for an existing controller 200, a software application on a user mobile device 300 may query the existing controller to extract its programmable parameters, pre-populate selection criteria in the application with the extracted parameters, and download the selections to the replacement controller 200.

In some embodiments, a user may enter (e.g., by typing, by photographing, by barcode scanning, by RFID scanning, by voice command, or the like) a type and number for a particular HVAC controller 200 (which may be new or a replacement) into a software application on the user's mobile device 300, after which the application contacts a remote server (not shown) to obtain parameter selection criteria for the user-identified controller 200. The server may fetch the parameter selection information from a database and send the values to the application for download to the controller 200. In some embodiments, the parameter selection criteria is stored ahead of time in the mobile device 300, and does not need to be retrieved from the remote server during setup. Thus, the mobile device 300 may determine settings (such as default settings) at least in part by retrieving them from a remote server or retrieving them from its own memory.

Moreover, in some embodiments, the user may enter (e.g., by typing, by photographing, by barcode scanning, by RFID scanning, by voice command, or the like) identifying information, such as a type, a size, and part number, or the like, for multiple components of the system 100, such as the controller, the motor(s), the external heat exchanger, duct sizes/lengths, and the like, into a software application on the user's mobile device 300. The application may then determine and/or retrieve configuration settings for the controller 200 to allow the controller to control the system 100. The retrieved configuration settings may then be transmitted, via the communication interface 314, to the controller 200. In some embodiments, the user may, if desired, modify the retrieved configuration settings and/or set additional settings before downloading the settings to the controller 200.

Thus, in various embodiments, all configurable parameters may be automatically selected, and the installer or other user may modify one or more parameters based, e.g., on installation specifics. As one example, an installer might adjust a parameter for the speed of a circulator, to suit the total duct length at an installation site. In other embodiments, less than all (including none) of the configurable parameters are automatically selected, and the installer or other user sets the parameters.

In some embodiments, the user inputs (e.g., via typing, capturing an image, barcode scanning, RFID reading, NFC communicating, or the like) details of the installation, into an installation application on the mobile device 300. The details of the installation can include, the specific motors used in the system, the size of the outdoor unit(s), the length of ducts, and the like. The application retrieves (either from a remote server or from memory 304) information on the identified components of the system and determines the recommended settings for the controller 200 to operate the system 100, including timings, alarms, motor control settings such as motor speed, CFM, or torque settings, and the like.

In some embodiments, the location of the system 100 is obtained by the mobile device 300, either by user input, by geolocation services included in the mobile device, or by any other suitable manual or automatic techniques. This location information may be use in setting the initial blower operating speeds appropriate for the location of the system 100.

The controller 200 is configured, such as by instructions stored in memory 204 and executed by processor 202, to control the HVAC system 100. In response to a command from the thermostat 118, the controller 200 will control the system 100 to cool or heat air within the enclosed space 101.

When cooling, the controller 200 can selectively control the speed of the blower 112 to emphasize cooling efficiency or dehumidification efficiency. That is, the controller 200 may operate the blower 112 at a slower speed to decrease the airflow rate (e.g., cubic feet per minute per ton of system capacity-CFM/ton) to increase humidity efficiency or at a faster speed to increase the airflow rate and the increase cooling efficiency (which also may improve energy efficiency). The adjustment from slowest to fastest speeds may be a continuous scale such that any speed between the slowest and the fastest may be used. Alternatively adjustment from slowest to fastest speeds may be may be a selection between two or more discrete speeds. For example, a lower speed may be associated with cooling when the ambient humidity is above or equal to a threshold and a higher speed may be associated with cooling when the ambient humidity is below the threshold. Other embodiments may use three ranges in include a default range associated with a speed between the lower speed and the higher speed that is a compromise between high cooling efficiency and high dehumidification efficiency. The lowest and highest speeds are set within a range around a standard (or default) speed to achieve a default airflow rate per ton of capacity for the geographical location in which the system 100 is located. For example, in a dry (low humidity) geographic location, the default speed when cooling may be the speed to achieve 450 CFM/ton airflow, in a high humidity location the default speed may be the speed to achieve 350 CFM/ton airflow, and in a moderate humidity (between high and low humidity) location the default speed may be the speed to achieve 400 CFM/ton airflow. In some embodiments, the lower and higher speeds are speeds that achieve 50 CFM/ton less than and greater than the default speed for the geographic location.

In some embodiments, the controller 200 can automatically control the humidification system 109 when heating to add moisture to the air in the enclosed space 101 as needed. That is, if the humidity in the enclosed space 101 is below a threshold value, the controller 200 may turn on the humidification system 109 to add humidity to the enclosed space 101 while heating and until the humidity in the enclosed space reaches the threshold. In some embodiments, the controller 200 receives an outdoor temperature from an outdoor temperature sensor (e.g., sensor 124) and controls the humidification system based on the humidity in the enclosed space 101 and the outdoor temperature. This allows the controller 200 to control the humidity in the enclosed space to a level that does not result in condensation forming on any windows of the enclosed space 101.

Figure 4:
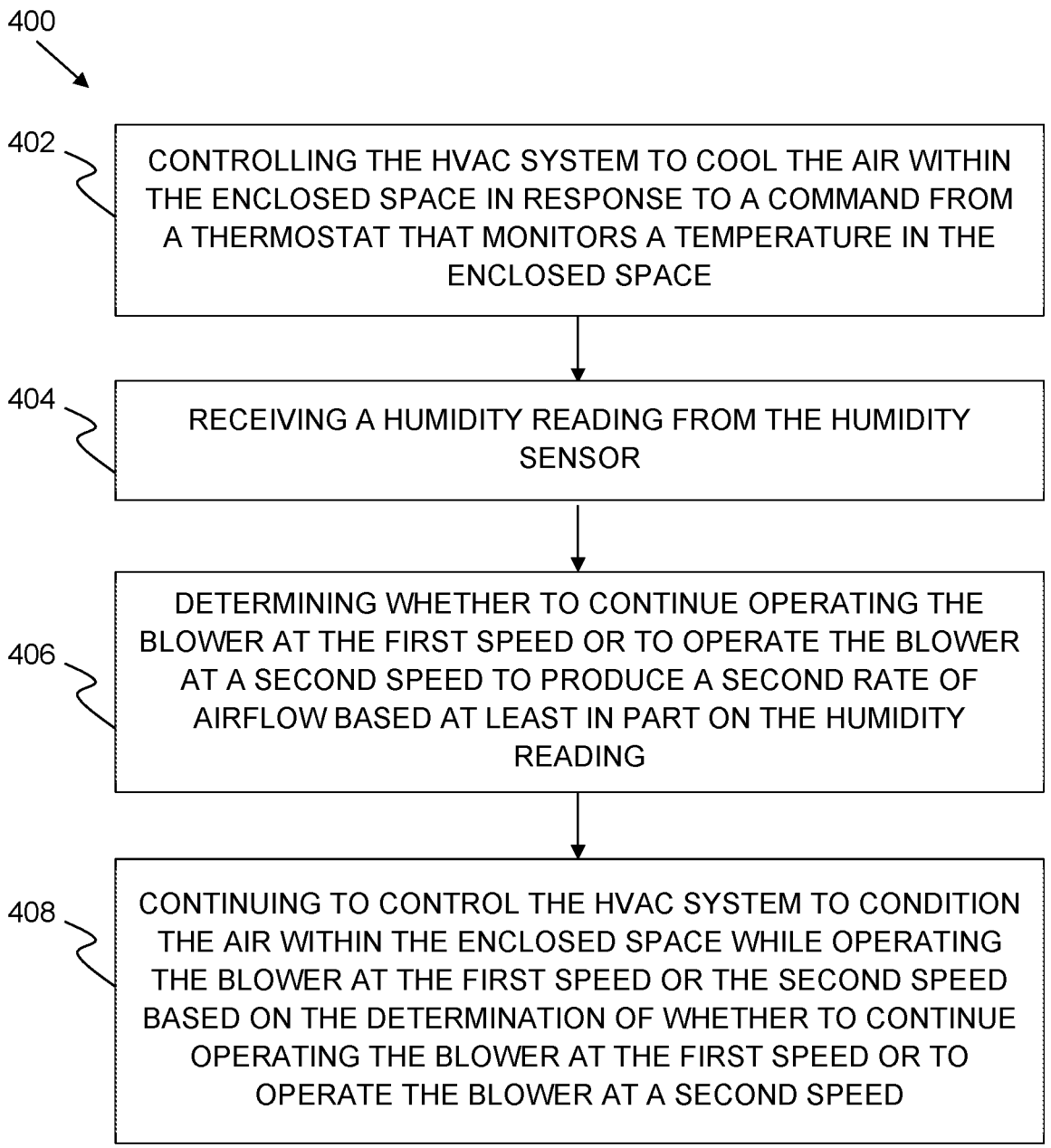
FIG. 4 is a flow diagram of a method of controlling an HVAC system.

FIG. 4 is a flow diagram of a method 400 of conditioning air within the enclosed space 101 using the HVAC system 100. The method will be described as being performed by the controller 200 on the system 100, but the method may be performed by other controllers to control other systems.

At 402, the controller 200 controls the HVAC system 100 to cool the air within the enclosed space 101 in response to a command from the thermostat 118. Controlling operation of the system 100 includes operating the blower at a first speed to produce a first rate of airflow. In some embodiments, the first rate of airflow is a default rate of airflow for the geographical location of the HVAC system 101 and the first speed is stored in memory 204 and is a default speed to produce the default rate of airflow. In some embodiments, the speed is the last speed to which the controller 200 controlled the blower 112 in response to a previous command from the thermostat 118. That is, the first speed may simply be the speed used last time the controller operated the HVAC system 100.

In some embodiments, the method 100 may include determining the default speed to produce the default rate of airflow for the geographical location of the HVAC system 100, and storing the default speed in the memory 204 of the controller 200. The default speed may be determined by an installer using tables produced by the manufacturer of some or all of the system 100, may be determined using mobile device 300, or by any suitable method.

The controller receives a humidity reading from a humidity sensor at 404. The humidity sensor may be humidity sensor 218 on the controller 200 or may be received from a humidity sensor located remotely from the controller 200, such a through one of the communication interfaces 212 or 214.

At 406, the controller 200 determines whether to continue operating the blower 112 at the first speed or to operate the blower 112 at a second speed to produce a second rate of airflow based on the humidity reading. In some embodiments, this determination is made by determining a range of the humidity reading from a plurality of humidity ranges, with each humidity range of the plurality of humidity ranges being associated with a blower speed to produce an airflow rate. The controller 200 decides to continue operating the blower at the first speed if the first speed is the blower speed associated with the determined range of the humidity reading, and decides to operate the blower at the second speed when the first speed is not the blower speed associated with the determined range of the humidity reading. The second speed is the blower speed associated with the determined range humidity reading. As a result, if the speed associated with the humidity range of the current humidity is the same speed as the speed that the blower 112 is already being controlled to, the controller 200 does not need to change the speed and the blower continues to be operated at the first speed. Conversely, if the speed associated with the humidity range of the current humidity is not the same speed as the speed that the blower 112 is already being controlled to, the controller 200 changes the speed of the blower to the speed associated with the humidity range that the current humidity is in In some embodiments, there are two humidity ranges defined by a single humidity threshold. A first humidity range is below a humidity threshold and a second humidity is above the humidity threshold. One of the ranges will also include the humidity threshold, and the selection between which includes the humidity threshold is generally arbitrary and may be reversed in different embodiments. The speed associated with the first humidity range will be faster than the speed associated with the second humidity range to achieve a higher airflow rate. Thus, the speed in the first range will emphasize cooling efficiency (quicker cooling, more energy efficiency, etc.), while the speed in the second range will emphasize dehumidification efficiency (quicker dehumidification).

In some embodiments, there are three humidity ranges defined by a two humidity thresholds. A first humidity range includes humidity below a first threshold humidity, a second humidity range includes humidity greater than a second threshold humidity, and a third humidity range includes humidity between the first threshold humidity and the second threshold humidity. Of course, one of the first and third range will also include the first humidity threshold and one of the second and third ranges will also include the second humidity threshold. The selection of which range includes the threshold is generally arbitrary and may be reversed in different embodiments. The first humidity range is the low humidity range, the third humidity range is the moderate humidity range, and the second humidity range is the high humidity range. The moderate humidity range may be considered the average or default range for the geographical location of the system 100 and its associated speed may be the blower speed recommended by the system manufacturer for that location. The speed associated with the first humidity range will be faster than the speed associated with the third humidity range and the speed associated with the third humidity range will be faster than the speed associated with the second humidity range. Thus, the speed in the first range will emphasize cooling efficiency (quicker cooling, more energy efficiency, etc.), the speed in the second range will emphasize dehumidification efficiency (quicker dehumidification), and the speed in the third range will be a compromise between cooling and dehumidification efficiency. In one example embodiment, the first threshold is forty percent relative humidity and the second threshold is fifty percent relative humidity. In an example embodiment, the speed associated with the first range is the speed to achieve 450 CFM/ton airflow, the speed associated with the second range is the speed to achieve 350 CFM/ton airflow, and the speed associated with the third range is the speed to achieve 400 CFM/ton airflow. Other embodiments use any other suitable humidity threshold values and/or speeds.

Still other embodiments include more than three humidity ranges. In all such embodiments, each range is associated with a different blower speed, with the blower speed decreasing as humidity increases. Still other embodiments use a continuous scale rather than ranges, with each possible humidity reading having an associated blower speed, with some humidity readings potentially having the same associated speed.

Figure 5:
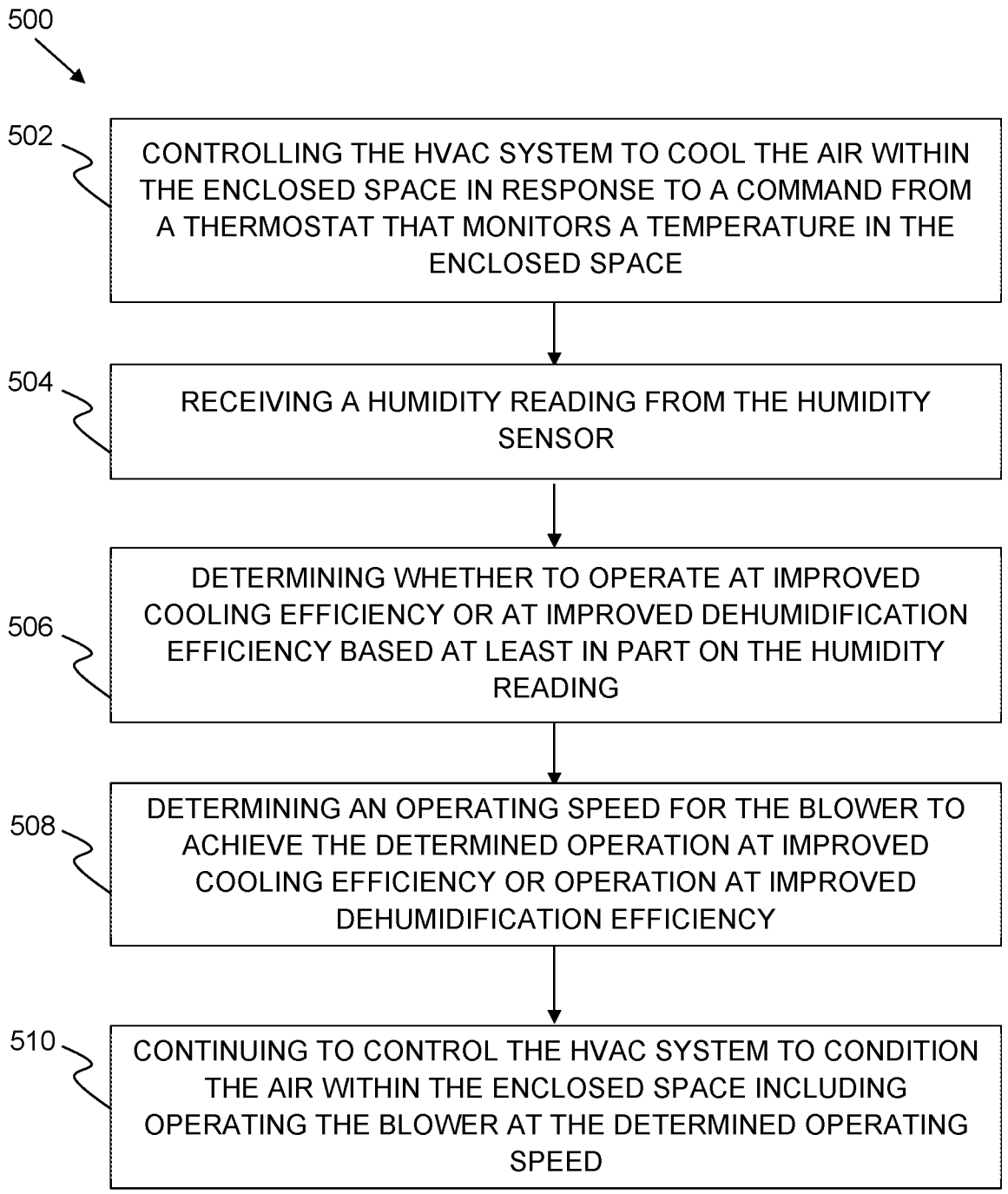
FIG. 5 is a flow diagram of another method of controlling an HVAC system.

FIG. 5 is a flow diagram of a method 500 of conditioning air within an enclosed space using an HVAC system. The method will be described as being performed by the controller 200 on the system 100, but the method may be performed by other controllers to control other systems.

At 502, the controller 200 controls the HVAC system 100 to cool the air within the enclosed space 101 in response to a command from the thermostat 118. The controller receives a humidity reading from a humidity sensor at 504. The humidity sensor may be humidity sensor 218 on the controller 200 or may be received from a humidity sensor located remotely from the controller 200, such a through one of the communication interfaces 212 or 214.

The controller 200 determines, at 506, whether to operate at improved cooling efficiency or at improved dehumidification efficiency based at least in part on the humidity reading. In some embodiments, the controller may determine between operating at improved cooling efficiency, at improved dehumidification efficiency, or at a default efficiency based on the humidity reading. The default efficiency may be the average or default settings for the geographical location of the system 100 as recommended, for example, by the system manufacturer.

In some embodiments, the determination is made by determining to operate at the improved cooling efficiency when the humidity reading is below a low humidity threshold, determining to operate at the improved humidity efficiency when the humidity reading is above a high humidity threshold, and determining to operate at the default efficiency when the humidity reading is greater or equal to the low humidity threshold and less than or equal to the high humidity threshold. In embodiments without a default efficiency option, a single threshold is used and the determination is made by determining to operate at the improved cooling efficiency when the humidity reading is below the threshold and determining to operate at the improved humidity efficiency when the humidity reading is above the threshold.

At 508, the controller determines an operating speed for the blower 112 to achieve the determined operation at improved cooling efficiency or operation at improved dehumidification efficiency. In embodiments in which a default efficiency is an option, this step includes determining an operating speed for the blower 112 to achieve the determined operation at improved cooling efficiency, operation at improved dehumidification efficiency, or operation at default efficiency.

The controller continues to control the HVAC system in 510 to condition the air within the enclosed space by operating the blower at the speed determined in 508.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of conditioning air within an enclosed space using a heating ventilation and air condition (HVAC) system including a humidity sensor, a blower in fluid communication with the enclosed space, and a controller having a processor and a memory, the method comprising:

controlling, by the controller, the HVAC system to cool the air within the enclosed space in response to a command from a thermostat that monitors a temperature in the enclosed space, the controlling including operating the blower at a first speed to produce a first rate of airflow;

receiving, by the controller, a humidity reading from the humidity sensor;

determining, by the controller, whether to continue operating the blower at the first speed or to operate the blower at a second speed to produce a second rate of airflow based at least in part on the humidity reading by:

determining a range of the humidity reading from a plurality of humidity ranges, each humidity range of the plurality of humidity ranges being associated with a blower speed to produce an airflow rate;

determining to continue operating the blower at the first speed if the first speed is the blower speed associated with the determined range of the humidity reading; and determining to operate the blower at the second speed when the first speed is not the blower speed associated with the determined range of the humidity reading, the second speed being the blower speed associated with the determined range humidity reading; and continuing to control, by the controller, the HVAC system to condition the air within the enclosed space while operating the blower at the first speed or the second speed based on the determination of whether to continue operating the blower at the first speed or to operate the blower at a second speed.

2. The method of claim 1, wherein the first rate of airflow comprises a default rate of airflow for a geographical location of the HVAC system, the first speed comprises a default speed to produce the default rate of airflow, and the default speed is stored in the memory of the controller.

3. The method of claim 2, further comprising:

determining the default speed to produce the default rate of airflow for the geographical location of the HVAC system; and storing the default speed in the memory of the controller.

4. The method of claim 1, wherein the first speed comprises a last speed to which the controller controlled the blower in response to a previous command from the thermostat.

5. The method of claim 1, wherein the plurality of humidity ranges comprises three humidity ranges.

6. The method of claim 5, wherein a first humidity range of the three humidity ranges includes humidity below a first threshold humidity, a second humidity range of the three humidity ranges includes humidity greater than a second threshold humidity greater than the first threshold humidity, and a third humidity range includes humidity greater than or equal to the first threshold humidity and less than or equal to the second threshold humidity.

7. The method of claim 6, wherein the blower speed associated with the first humidity range is faster than the blower speed associated with the third humidity range, and the blower speed associated with the third humidity range is faster than the blower speed associated with the second humidity range.

8. The method of claim 6, wherein the first threshold is forty percent relative humidity and the second threshold is fifty percent relative humidity.

9. The method of claim 1, wherein the HVAC system includes a humidification system, the method further comprising:

controlling, by the controller, the HVAC system to heat the air within the enclosed space in response to a command from the thermostat; and controlling the humidification system to add humidity to the enclosed space based at least in part on the humidity reading.

10. The method of claim 9, wherein the HVAC system includes an outdoor temperature sensor, the method further comprising:

receiving, by the controller an outdoor temperature reading from the outdoor temperature sensor, wherein controlling the humidification system comprises controlling the humidity system to add humidity to the enclosed space based on the humidity reading and the outdoor temperature reading.

11. A method of conditioning air within an enclosed space using a heating ventilation and air condition (HVAC) system including a humidity sensor, a blower in fluid communication with the enclosed space, and a controller having a processor and a memory, the method comprising:

controlling, by the controller, the HVAC system to cool and dehumidify the air within the enclosed space according to a default setting in response to a command from a thermostat that monitors a temperature in the enclosed space;

receiving, by the controller, a humidity reading from the humidity sensor;

determining, by the controller, whether to operate the HVAC system to increase cooling efficiency of the HVAC system over control according to the default setting or to increase dehumidification efficiency of the HVAC system over control according the default setting based at least in part on the humidity reading;

determining, by the controller, an operating speed for the blower to achieve the determined operation to increase cooling efficiency or operation to increase dehumidification efficiency; and continuing to control, by the controller, the HVAC system to condition the air within the enclosed space including operating the blower at the determined operating speed.

12. The method of claim 11, wherein determining whether to operate the HVAC system to increase cooling efficiency or to increase dehumidification efficiency comprises determining whether to operate at the default setting, to increase cooling efficiency or to increase dehumidification efficiency based at least in part on the humidity reading, and determining the operating speed for the blower comprises determining the operating speed for the blower at the default setting, to increase cooling efficiency, or to increase dehumidification efficiency.

13. The method of claim 12, wherein determining whether to operate at the default setting, to increase cooling efficiency or to increase dehumidification efficiency based at least in part on the humidity reading comprises:

determining to operate to increase cooling efficiency when the humidity reading is below a low humidity threshold;

determining to operate to increase humidity efficiency when the humidity reading is above a high humidity threshold; and determining to operate at the default setting when the humidity reading is greater or equal to the low humidity threshold and less than or equal to the high humidity threshold.

14. The method of claim 11, wherein determining the operating speed for the blower at the default setting, to increase cooling efficiency, or increase dehumidification efficiency comprises determining a first speed as the operating speed for operation at the default setting, determining a second speed as the operating speed to increase cooling efficiency, and determining a third speed as the operating speed to increase dehumidification efficiency, the second speed being faster than the first speed and the third speed being slower than the first speed.

15. A controller for a heating ventilation and air condition (HVAC) system including a blower in fluid communication with an enclosed space, the controller comprising:

a processor; and a memory, the memory storing instructions that when executed by the processor cause the processor to control the HVAC system to cool the air within the enclosed space in response to a command from a thermostat that monitors a temperature in the enclosed space, the control including operating the blower at a first speed to produce a first rate of airflow;

receive a humidity reading from a humidity sensor;

determine whether to continue operating the blower at the first speed or to operate the blower at a second speed to produce a second rate of airflow based at least in part on the humidity reading by:

determining a range of the humidity reading from a plurality of humidity ranges, each humidity range of the plurality of humidity ranges being associated with a blower speed to produce an airflow rate;

determining to continue operating the blower at the first speed if the first speed is the blower speed associated with the determined range humidity reading; and determining to operate the blower at the second speed when the first speed is not the blower speed associated with the determined range humidity reading, the second speed being the blower speed associated with the determined range humidity reading; and continue controlling the HVAC system to condition the air within the enclosed space while operating the blower at the first speed or the second speed based on the determination of whether to continue operating the blower at the first speed or to operate the blower at a second speed.

16. The controller of claim 15, wherein the controller includes the humidity sensor.

17. The controller of claim 15, wherein the first rate of airflow comprises a default rate of airflow for a geographical location of the HVAC system, the first speed comprises a default speed to produce the default rate of airflow, and the default speed is stored in the memory of the controller.

18. The controller of claim 15, wherein the first speed comprises a last speed to which the controller controlled the blower in response to a previous command from the thermostat.

* * * * *